US005435413A

United States Patent [19]

Schoenborn

[11] Patent Number: 5,435,413

[45] Date of Patent: Jul. 25, 1995

[54] OIL DRAINAGE DEVICE

[76] Inventor: Perry Schoenborn, 1017 Nichol St., Bottineau, N. Dak. 58318

[21] Appl. No.: 108,232

[22] Filed: Aug. 19, 1993

[51] Int. Cl.[6] ..... F16C 3/14

[52] U.S. Cl. ..... 184/1.5; 184/28; 184/105.3; 134/169 A; 141/65; 141/98; 141/382; 141/386; 403/349

[58] Field of Search ..... 184/1.5, 6.28, 26, 27.1, 184/27.3, 28, 105.3; 123/196 R; 134/169 A; 141/65, 98, 325, 326, 382, 386; 403/348, 349; 415/124

[56] References Cited

U.S. PATENT DOCUMENTS

| | | | |
|---|---|---|---|
| 1,648,223 | 11/1927 | Gullborg | 184/105.3 |
| 3,145,912 | 8/1964 | Weis | 415/124 |
| 4,095,674 | 6/1978 | Kido et al. | 184/6.28 |
| 4,721,185 | 1/1988 | Weigle | 123/196 R |
| 4,815,566 | 3/1989 | Caruso et al. | 184/1.5 |
| 4,880,156 | 11/1989 | Wallet | 184/1.5 |
| 4,909,205 | 3/1990 | Bewley, III | 184/1.5 |
| 4,930,602 | 6/1990 | Gust | 184/1.5 |
| 5,048,578 | 9/1991 | Dorf et al. | 184/1.5 |
| 5,074,380 | 12/1991 | Bedi et al. | 123/196 R |
| 5,143,178 | 9/1992 | Latham, Jr. | 184/1.5 |
| 5,148,785 | 9/1992 | Sendak | 184/1.5 |

*Primary Examiner*—Edward K. Look
*Assistant Examiner*—Christopher Verdier

[57] ABSTRACT

A new and improved oil drainage device. The device includes an oil receptacle upon which is mounted an oil pump. The pump can be connected, by way of a length of flexible tubing and a quick coupling, to the drainage hole of an oil pan. Thus, the device serves to pump oil from the drainage hole through the tubing and into the receptacle. The receptacle can alternatively be removably coupled to a larger oil receptacle by way of coupling assembly so that the receptacle is for industrial applications, whereas the former embodiment is for individual automotive or marine use.

5 Claims, 4 Drawing Sheets

OIL DRAINAGE DEVICE

BACKGROUND OF THE INVENTION

1. Field of the Invention

The present invention relates to an oil drainage device and more particularly pertains to an oil drainage device which pumps engine oil from the drain hole of an oil pan to a container.

2. Description of the Prior Art

The use of engine oil drainage devices is known in the prior art. More specifically, devices heretofore devised and utilized for the purpose of draining oil are known to consist basically of familiar, expected and obvious structural configurations, notwithstanding the myriad of designs encompassed by the crowded prior art which have been developed for the fulfillment of countless objectives and requirements.

U.S. Pat. No. 5,074,379 discloses an automotive oil change apparatus. The apparatus includes an electrical pump and electromechanical coupling mounted within the engine compartment for pumping used motor oil from the engine oil pan.

U.S. Pat. No. 5,044,334 discloses a process and apparatus for changing the oil in an engine. The device includes an external pump device.

U.S. Pat. No. 248,396 discloses a pump for changing oil.

Another patent of interest is U.S. Pat. No. 5,070,831 which illustrates an oil change system and method. The system employs a flexible hose with a quick disconnect female coupling for connecting an oil tank to the engine.

Yet another patent of interest is U.S. Pat. No. 4,909,205 which illustrates a method and apparatus for changing engine oil. The apparatus includes an external oil reservoir and a mount for an oil filter.

While these oil devices fulfill their respective, particular objectives and requirements, the aforementioned patents do not describe an oil change device which includes a portable container with an oil pump secured thereto. Furthermore, the prior art devices do not describe such a device which can be removably coupled to a larger oil container.

In this respect, the oil drainage according to the present invention substantially departs from the conventional concepts and designs of the prior art, and in so doing provides an apparatus primarily developed for the purpose of pumping oil from the drain hole of an oil pan to a container.

Therefore, it can be appreciated that there exists a continuing need for new and improved devices which can be pump spent oil from an oil pan or other container. In this regard, the present invention substantially fulfills this need.

SUMMARY OF THE INVENTION

In view of the foregoing disadvantages inherent in the known types of oil drainage devices now present in the prior art, the present invention provides an improved drainage construction wherein the same can be utilized for pumping spent oil from a drain pan or other container. As such, the general purpose of the present invention, which will be described subsequently in greater detail, is to provide a new and improved oil drainage device apparatus and method which has all the advantages of the prior art devices for draining oil and none of the disadvantages.

To attain this, the present invention essentially comprises an oil drainage device designed to remove oil through the drain hole of an oil pan. The drainage device is comprised of a rectangular receptacle having a top surface, a bottom surface and sidewalls therebetween. First and second apertures are positioned within the top surface of the receptacle. A closure cap is removably received over the first aperture of the receptacle. The device includes a pump having an inlet and an outlet. The pump outlet is coupled to the second aperture of the receptacle. A quick connect coupling is adapted to be removably secured to the drain hole of an oil pan. A length of flexible hose interconnects the quick coupling and the inlet of the pump.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil drainage device which has all the advantages of the prior art devices and none of the disadvantages.

It is another object of the present invention to provide a new and improved oil drainage device which may be easily and efficiently manufactured and marketed.

It is a further object of the present invention to provide a new and improved oil drainage device which is of a durable and reliable construction.

An even further object of the present invention is to provide a new and improved oil drainage device which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved oil drainage device which provides in the apparatuses and methods of the prior art some of the advantages thereof, while simultaneously overcoming some of the disadvantages normally associated therewith.

Still another object of the present invention is to provide a new and improved device for pumping oil from an oil pan of an internal combustion engine of a car, truck, boat or the like.

Yet another object of the present invention is to pump spent oil from its location of use to a receptacle.

Even still another object of the present invention is to collect spent oil in a container, a small container for small personal applications or a large drum container for large industrial applications.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
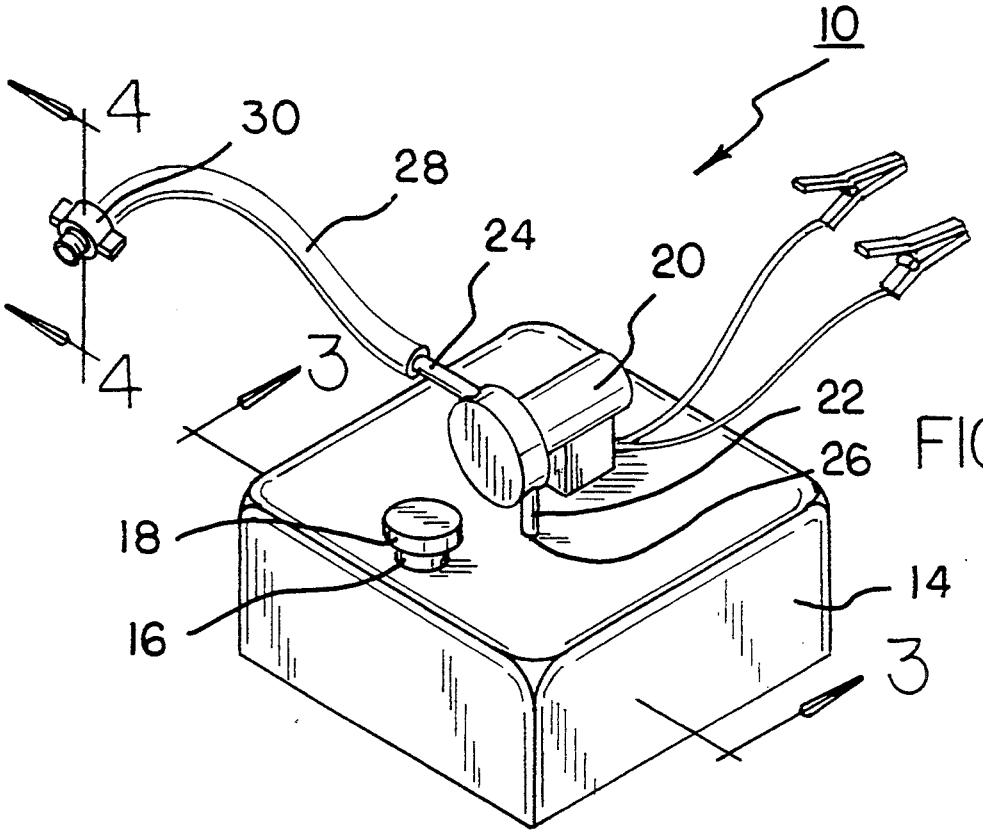
FIG. 1 is a perspective view of a device constructed in accordance with the first embodiment of the present invention.
Figure 2:
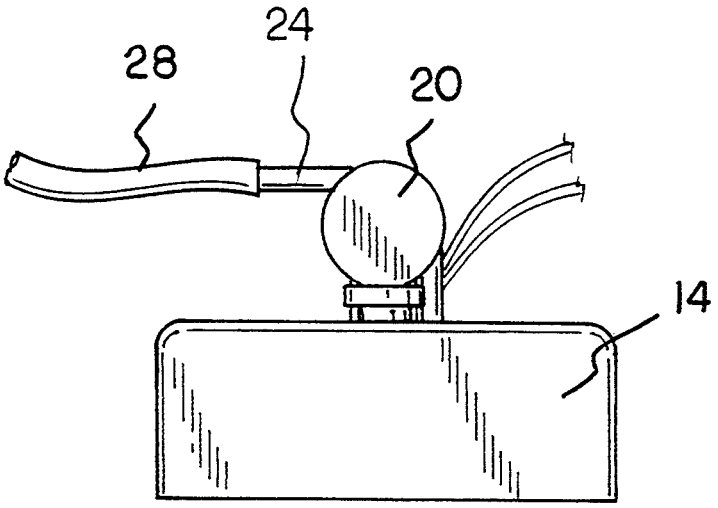
FIG. 2 is an elevational view of the device in accordance with the first embodiment.
Figure 3:
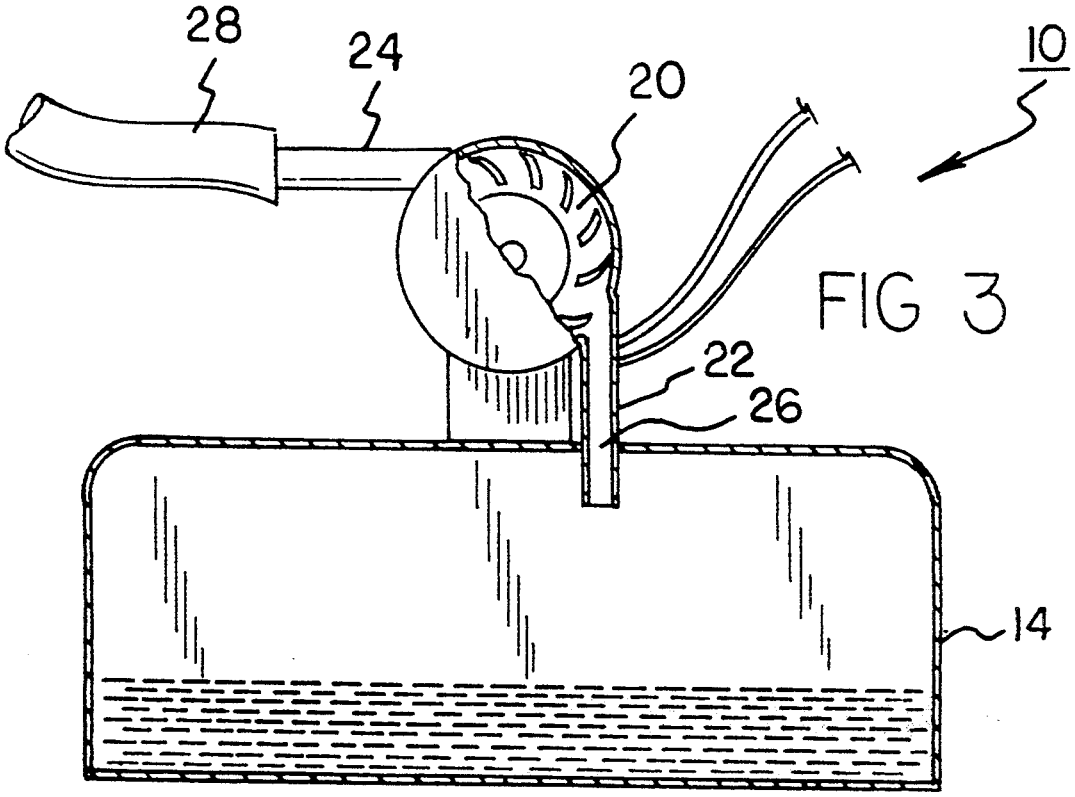
FIG. 3 is a sectional view of the device taken through line 3—3 of FIG. 1.

With reference now to the drawings, and in particular to FIG. 1 thereof, a new and improved oil drainage device embodying the principles and concepts of the present invention and generally designated by the reference numeral 10 will be described.

The present invention illustrates an oil drainage device 10 which is designed to remove the used or spent oil from an internal combustion engine or other storage chamber, not shown. The oil is preferably removed through the drain hole 12 of the oil pan assembly of the engine. The oil drainage device includes several components.

The first component is a rectangular receptacle 14 which is designed to accept and store a quantity of spent oil pumped thereto. The receptacle includes a top surface, a bottom surface and four surrounding sidewalls. Included within the top surface of the receptacle is an aperture 16 which is sealed by a removable cap 18. This first aperture 16 enables the user to extract the spent oil from the receptacle. Mounted upon the top surface of the receptacle is a pump 20. The pump is of a capacity and design to enable it to pump oil and other such heavy fluids. Many commercially available pumps are suitable. The pump has an outlet 22 and inlet 24. The outlet 22 of the pump is connected to a second aperture 26 located within the top surface of the receptacle. The mouth of the second aperture can employ a fine screen element to filter out any particles that might exist within the oil.

Figure 4:
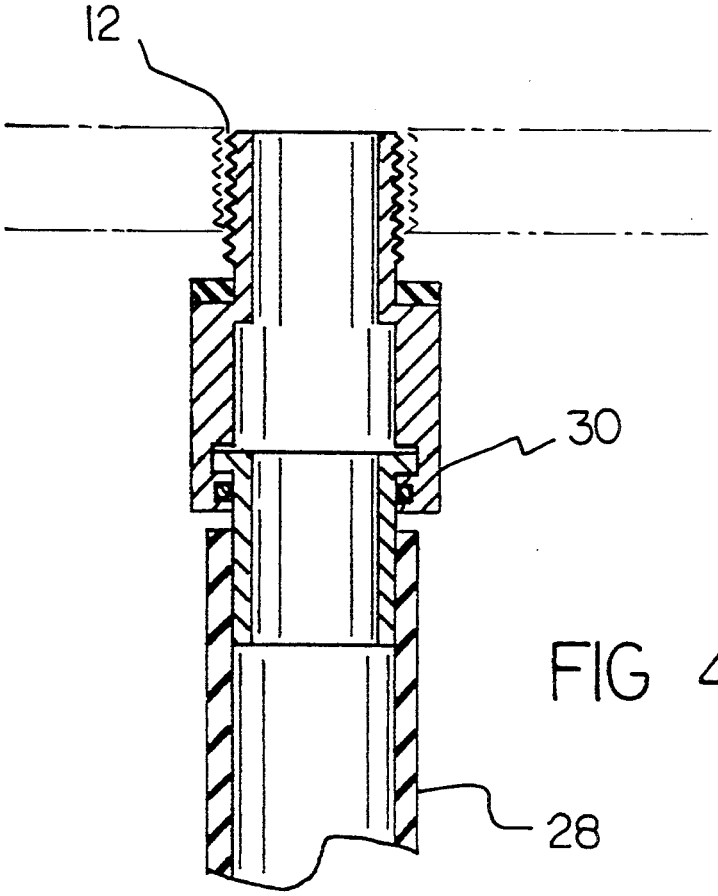
FIG. 4 is a sectional view of the quick connect taken through line 4—4 of FIG. 1.
Figure 5:
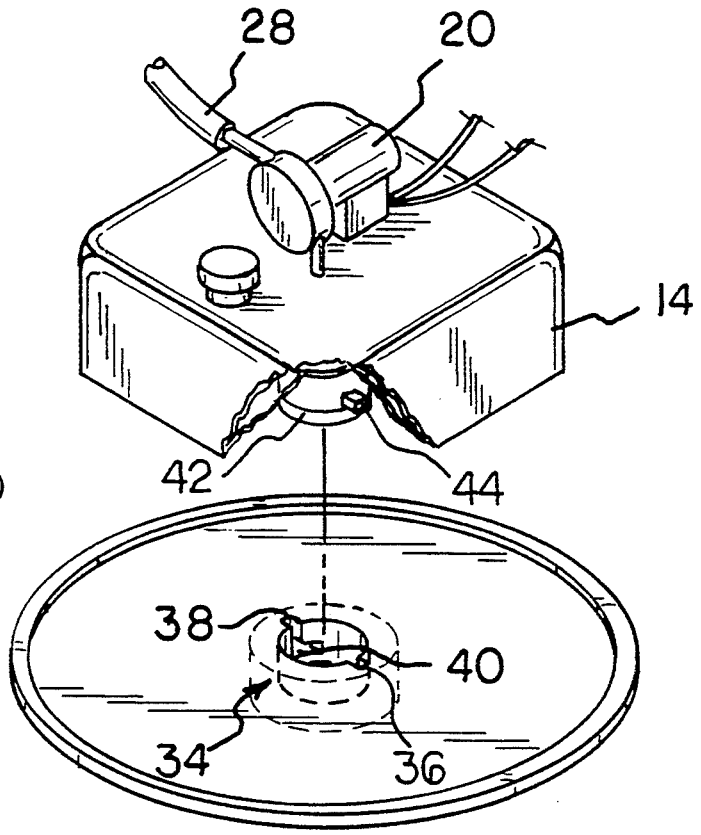
FIG. 5 is a perspective view of the device in accordance with the second embodiment.
Figure 6:
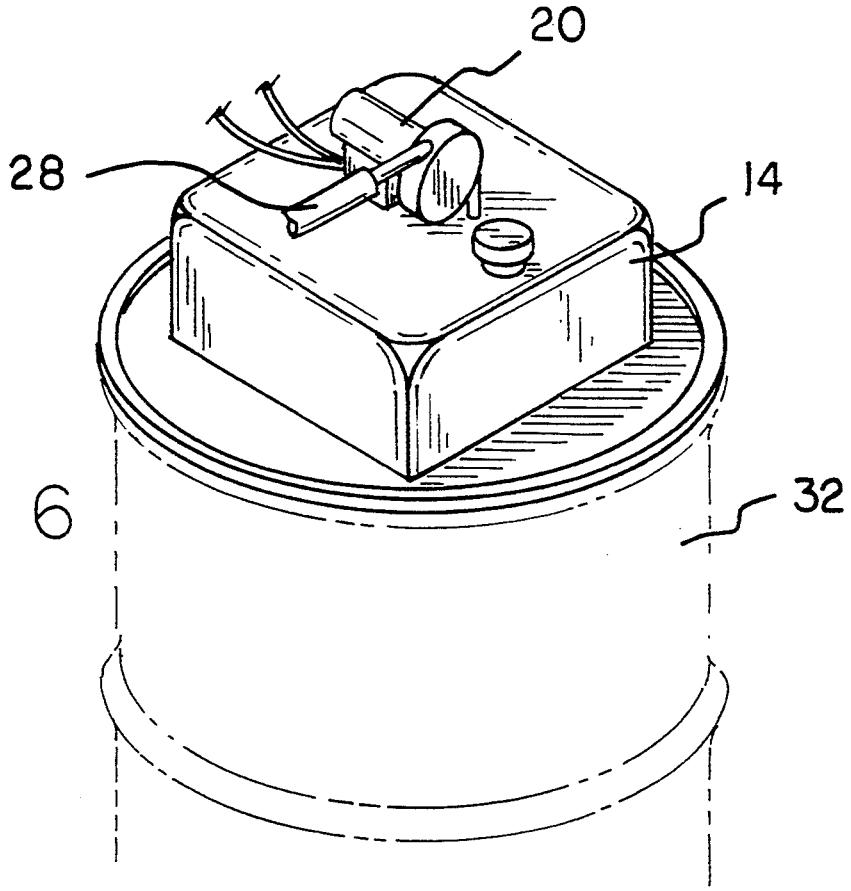
FIG. 6 is another perspective view of the device in accordance with the second embodiment but coupled to a large container.
Figure 7:
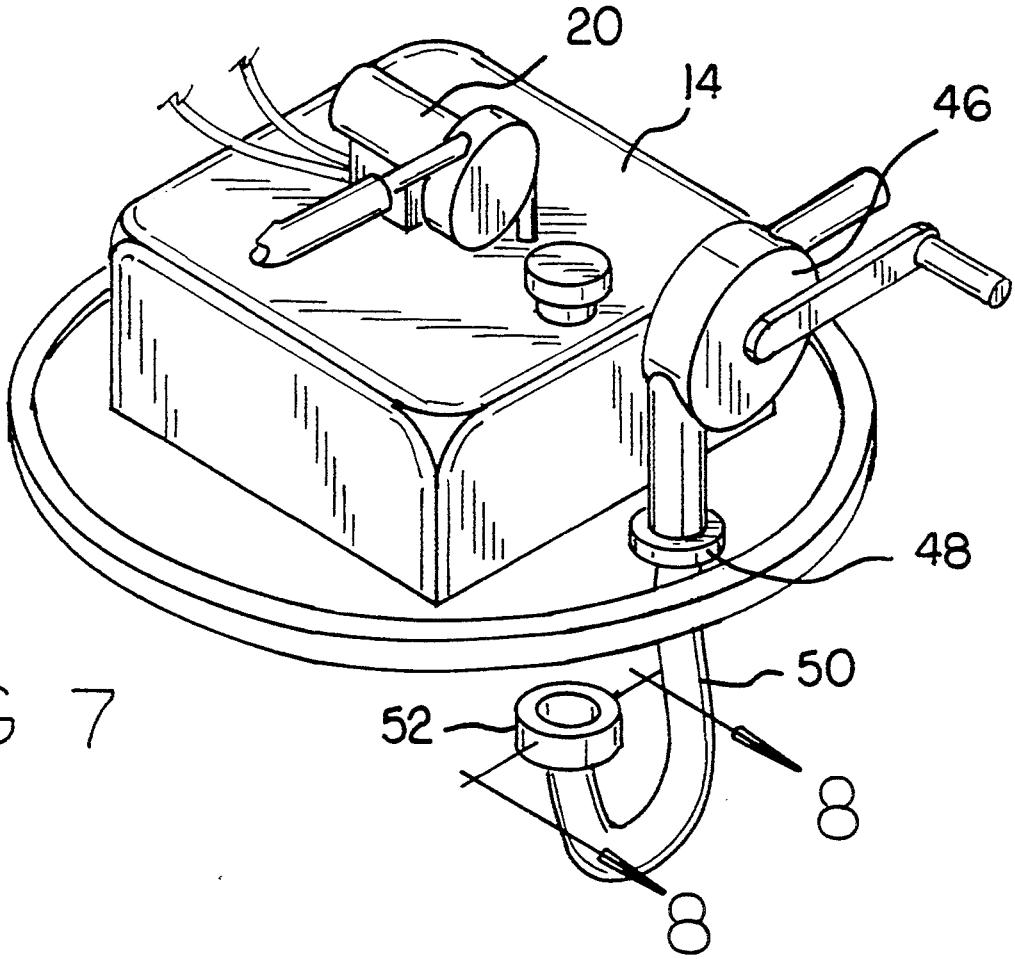
FIG. 7 is a perspective view of the device in accordance with the second embodiment similar to FIG. 6 but with the hand pump included.
Figure 8:
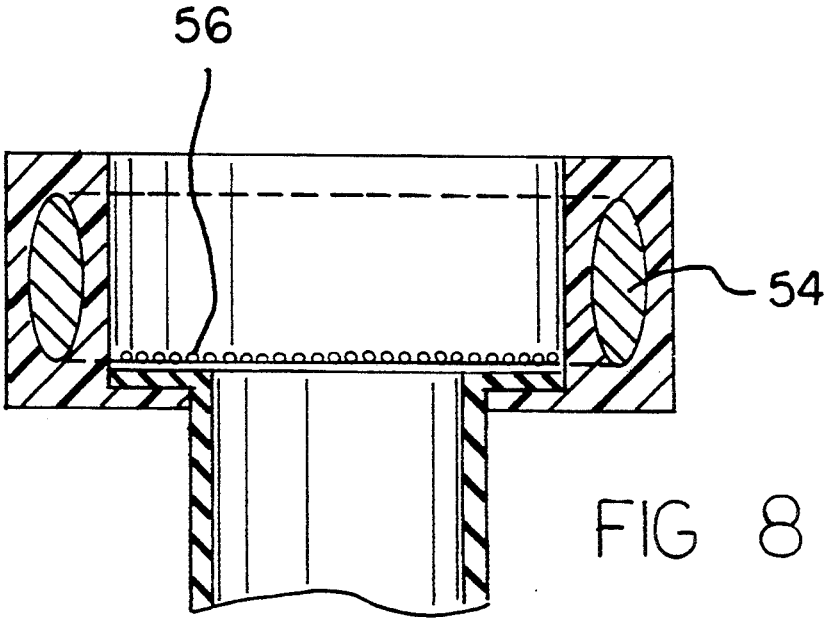
FIG. 8 is a sectional view taken along line 8—8 of FIG. 7.

The inlet 24 of the pump is coupled to a length of flexible tubing 28. The flexible tubing terminates in a quick connect coupling 30, note FIG. 4. The quick connect coupling can be any variety of fastening element, which allows for the rapid connection of the tubing to the drain hole of an oil pan. The preferred coupling element has threads on its exterior end releasable with threads within the drain hole of the oil pan with outwardly projecting members to assist a user in rotating the coupling element for connecting or disconnecting. The length of flexible tubing 28 interconnects, and provides fluid communication between, the quick connect coupling 30, the inlet 24 of the pump and the interior of the receptacle 14 during the pumping of spent oil.

In use, the quick connect coupling 30 is connected to the drain hole 12 of an oil pan assembly. The pump unit 20 is then coupled to an external source of power. FIG. 1 shows battery hook ups for this purpose. Common AC connections could be employed. Thus, oil can be pumped from the oil pan through the length of flexible tubing 28, and into the interior of the receptacle 14. The oil can then be stored within the receptacle until a suitable location is found for its ecological disposal. The oil can be extracted through the first aperture 16 of the receptacle. Furthermore, measuring devices, as for example a conventional dip stick, can be inserted within the first aperture to monitor the oil level within the receptacle.

The above described embodiment is suitable for individual use in conjunction with an automobile, truck, watercraft or the like. For use in an industrial capacity, however, a larger oil storage container is desired. The second embodiment of the device allows for such an increased oil storage capacity.

The second embodiment of the device employs a drum container 32. The drum container includes an upper surface and a lower surface and a surrounding cylindrical wall. The drum container also includes a cylindrical aperture 34 centrally located within its upper surface. Formed within the cylindrical sidewalls of the aperture 34 is a pair of diametrically opposed, oppositely oriented L-shaped slots 36. Each slot is comprised of a vertically extending section 38 and a horizontally extending section 40. Each horizontally extending section 40 has a curvature to match the walls of the cylindrical aperture.

The drainage device of the second embodiment further includes a cylindrical coupling assembly 42 for removably coupling the receptacle 14 to the container 32. The coupling assembly includes an upper extent and a lower extent. The upper extent of the coupling assembly is coupled to and in fluid communication with the bottom surface of the rectangular receptacle 14. A pair of diametrically opposed protruding tabs 44 are integral with the lower extent of the coupling assembly. The protruding tabs 44 are designed to be received within the L-shaped slots of the cylindrical aperture. The tabs are initially received within the vertical extents 38 of the slots, and then are slid downwardly and into the curved horizontal 40 extents, all for convenient connection and disconnection.

The upper surface of the drum also contains a second aperture 48 for use in draining the drum container. The second aperture can be covered with a removable cap, not shown. Alternatively, a hand operated pump 46 can be used in conjunction with the second aperture 48 to aid in draining the drum container. The lower end of the hand pump is coupled to tubing 50 with a collar 52 at its opposite end. The collar is provided with weights 54 to insure its fluid communication with the spent oil to be pumped. In addition, a screen 56 is employed to filter out large particles from the spent oil being pumped.

In use, the coupling assembly 42 of the connected rectangular receptacle is coupled to the drum container 32. This is accomplished by inserting the protruding tabs 44 into the L-shaped slots 38 and 40 of the drum container. As the protruding tabs are slid down the vertical extents and into the horizontal extents the coupling assembly is rotated approximately 90 degrees. The turning of the coupling assembly serves to lock the assembly, and the rectangular receptacle upon the drum container. With the coupling assembly locked within the drum aperture, the drum container and the rectangular receptacle are in fluid communication. The quick connect coupling is next connected to the drain hole 12 of the oil pan assembly. The pump 20 is then connected to a source of power. Oil is then pumped from the oil pan, through the flexible tubing 28, into the rectangular receptacle 14, and then finally into the larger drum container 32. When the drum container becomes full, the coupling assembly and connected rectangular receptacle 14 can be uncoupled from the drum container and coupled to a further container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oil drainage device adapted to remove oil through a drain hole of an oil pan, the drainage device comprising:

a rectangular receptacle having a top surface, a bottom surface, and four sidewalls therebetween, first and second apertures positioned within the top surface of the receptacle, and a third aperture positioned within the bottom surface of the receptacle;

a closure cap removably received over the first aperture of the receptacle;

a pump having an inlet and an outlet, the pump outlet coupled to the second aperture of the receptacle;

a quick connect coupling adapted to be removably secured to the drain hole of the oil pan;

a length of flexible hose interconnecting the quick connect coupling and the inlet of the pump;

a drum container having an upper surface and a lower surface and a cylindrical wall therebetween, the drum container having an aperture within its upper surface, the aperture including a pair of diametrically opposed, oppositely oriented L-shaped slots;

a cylindrical coupling assembly having an upper extent and a lower extent, the upper extent of the coupling assembly connected to the third aperture of the rectangular receptacle; and a pair of diametrically opposed outwardly protruding tabs positioned at the lower extent of the coupling assembly, the protruding tabs adapted to be inserted and locked within the L-shaped slots of the drum container, the locking of the protruding tabs within the L-shaped slots serving to bring the rectangular receptacle and the drum container into fluid communication.

2. An oil drainage device designed to remove oil through a drain hole of an oil pan, the drainage device comprising:

a rectangular receptacle having a top surface, a bottom surface and sidewalls therebetween, first and second apertures positioned within the top surface of the receptacle;

a closure cap removably received over the first aperture of the receptacle;

a pump having an inlet and an outlet, the pump outlet received within the second aperture of the receptacle;

a quick connect coupling adapted to be removably secured to the drain hole of an oil pan; and a length of flexible hose interconnecting the quick connect coupling and the inlet of the pump.

3. The oil drainage device of claim 2 further comprising:

a cylindrical drum container having an upper surface, a lower surface and a cylindrical sidewall therebetween;

means for removably coupling the bottom surface of the rectangular receptacle to the upper surface of the cylindrical drum such that the rectangular receptacle and the cylindrical drum are in fluid communication.

4. The oil drainage device of claim 3 and further including a hand pump for removing oil from the drum.

5. The oil drainage device of claim 2 and further including a screen in the path of oil being conveyed to preclude passage of large particles.

* * * * *